US012421753B2

(12) United States Patent
Stucky et al.

(10) Patent No.: US 12,421,753 B2
(45) Date of Patent: Sep. 23, 2025

(54) SEAT MOUNT FOR TENTS

(71) Applicants: Jennifer Stucky, Marietta, GA (US); Croswell Brim, Marietta, GA (US); Lyle Stucky, Marietta, GA (US)

(72) Inventors: Jennifer Stucky, Marietta, GA (US); Croswell Brim, Marietta, GA (US); Lyle Stucky, Marietta, GA (US)

(73) Assignee: BLEACHER BOUND, LLC, Marietta, GA (US)

( * ) Notice: Subject to any disclaimer, the term of this patent is extended or adjusted under 35 U.S.C. 154(b) by 135 days.

(21) Appl. No.: 18/110,536

(22) Filed: Feb. 16, 2023

(65) Prior Publication Data

US 2023/0258017 A1 Aug. 17, 2023

Related U.S. Application Data

(60) Provisional application No. 63/311,244, filed on Feb. 17, 2022.

(51) Int. Cl.
*E04H 15/62* (2006.01)

(52) U.S. Cl.
CPC ..... *E04H 15/62* (2013.01)

(58) Field of Classification Search
CPC ..... E04H 15/62
See application file for complete search history.

(56) References Cited

U.S. PATENT DOCUMENTS 2,790,452 A * 4/1957 Dusek ..... E04H 15/04 135/96
3,052,251 A 9/1962 Jean, Jr.
3,221,756 A * 12/1965 Rupright ..... A47B 37/04 135/147
3,417,764 A * 12/1968 Hemenway ..... E04H 15/58 135/144
5,201,858 A * 4/1993 Otrusina ..... A45F 5/02 24/3.1
5,347,693 A * 9/1994 Otrusina ..... A45F 5/02 24/3.12
5,579,797 A * 12/1996 Rogers ..... A45B 23/00 135/96
5,609,177 A * 3/1997 Iver ..... E04H 15/003 135/133
5,660,425 A * 8/1997 Weber ..... E04H 15/06 135/88.13
6,244,286 B1 6/2001 Russo
(Continued)

*Primary Examiner* — Noah Chandler Hawk
(74) *Attorney, Agent, or Firm* — Perilla Knox & Hildebrandt LLP

(57) ABSTRACT

A mounting base retains a leg of a tent in place on a seat pan/plank and a coupling secures the mounting base to the seat pan/plank to securely mount the tent to the seat. The mounting base includes a mounting plate with an open-ended slot that is sufficiently large to laterally slidingly receive the tent leg and sufficiently small to retain a foot of the tent leg from longitudinally passing through the slot. Typical embodiments include a recessed portion of the mounting base that receives the tent leg foot when the tent leg is in the slot, the coupling provided by a strap that mounts the mounting base to the seat pan, and a closure that closes off the slot to retain the tent leg in the slot, with the strap double functioning as the coupling and the closure in some embodiments.

20 Claims, 8 Drawing Sheets

(56) References Cited

U.S. PATENT DOCUMENTS

| | | | | |
|---|---|---|---|---|
| 6,866,054 | B1 * | 3/2005 | Collins | E04H 15/02 135/96 |
| 7,077,372 | B2 * | 7/2006 | Moran | A61B 90/39 248/221.11 |
| 7,213,869 | B1 * | 5/2007 | McClellan | E04H 12/2238 248/346.03 |
| 7,475,939 | B1 | 1/2009 | Hooker | |
| 7,896,015 | B2 * | 3/2011 | Milano, Jr. | E04H 15/06 135/117 |
| 8,296,999 | B2 | 10/2012 | Pescovitz | |
| 9,388,600 | B2 * | 7/2016 | Leathers | A47B 97/00 |
| 9,404,282 | B2 * | 8/2016 | Andrews | E04H 15/62 |
| 11,560,733 | B2 | 1/2023 | Volin | |
| 2011/0180679 | A1 * | 7/2011 | Ma | G09F 15/00 248/346.01 |
| 2021/0007497 | A1 | 1/2021 | Rowe, Jr. | |
| 2022/0228396 | A1 | 7/2022 | Pescovitz | |
| 2023/0003047 | A1 * | 1/2023 | Hostert | A47B 37/04 |

* cited by examiner

SEAT MOUNT FOR TENTS

CROSS-REFERENCE TO RELATED APPLICATION

This application claims the priority benefit of U.S. Provisional Patent Application Ser. No. 63/311,244, filed Feb. 17, 2022, which is hereby incorporated herein by reference.

TECHNICAL FIELD

The present invention relates generally to tents for providing shelter from weather, and particularly to mounting devices for securing tents in place.

BACKGROUND

Conventional bleachers include staggered tiers of bench seats provided for spectators of sporting and other events. Such bleachers are common in outdoor areas adjacent local/municipal sports fields where recreational leagues play baseball, soccer, lacrosse, football, and other games. However, these bleachers are typically uncovered, so while in the bleachers (seated or standing), spectators are fully exposed to inclement weather elements, for example sun, heat, rain, wind, cold, snow, etc., which can lessen their spectating enjoyment.

To provide shade and other shelter from the weather, some spectators bring pop-up canopy tents and install them on flat ground adjacent the field. But these spectators are then separated from friends and family seated in the bleachers, and these tents tend to blow away if the wind picks up, all of which can lessen spectating enjoyment.

Accordingly, it can be seen that needs exist for a way to provide shelter for spectators seated in outdoor bleachers. It is to the provision of solutions to this and other problems that the present invention is primarily directed.

SUMMARY

Generally described, the present invention relates to mounting devices that mount a tent to a seat. The mounting devices include a mounting base that retains a leg of a tent in place on a seat pan/plank and a coupling that secures the mounting base to the seat pan/plank to securely mount the tent to the seat. The mounting base includes a mounting plate with an open-ended slot that is sufficiently large to laterally slidingly receive the tent leg and sufficiently small to retain a foot of the tent leg from longitudinally passing through the slot. Typical embodiments include a recessed portion of the mounting base that receives the tent leg foot when the tent leg is in the slot, the coupling provided by a strap that mounts the mounting base to the seat pan, and a closure that closes off the slot to retain the tent leg in the slot, with the strap double functioning as the coupling and the closure in some embodiments.

The specific techniques and structures employed to improve over the drawbacks of the prior devices/methods and accomplish the advantages described herein will become apparent from the following detailed description of example embodiments and the appended drawings and claims.

DESCRIPTION OF EXAMPLE EMBODIMENTS

Generally described, the present invention relates to a mounting device for securing tents to seats. The mounting device can be used to mount various types of tents securely in place, including pop-up canopy tents (aka tailgate tents), beach tents and cabanas, and other tents, canopies, and shelters having a cover supported by adjustable-length legs, for example used for camping, trade shows, festivals, etc. Also, the mounting device can be used to mount tents securely in place to various types of seat pans, including those of bleacher (including grandstand) bench seats, stadium (including arena and theater) individual seats, other arrangements of tiers of bench seats and/or individual seats, and single bench seats (e.g., in parks or gardens, of picnic table sets, adjacent tennis courts, etc.), whether they're made of aluminum, wood, or other materials, whether they include footboards (aka floors) or not, and whether they include backrests and/or armrests or not.

Figure 1:
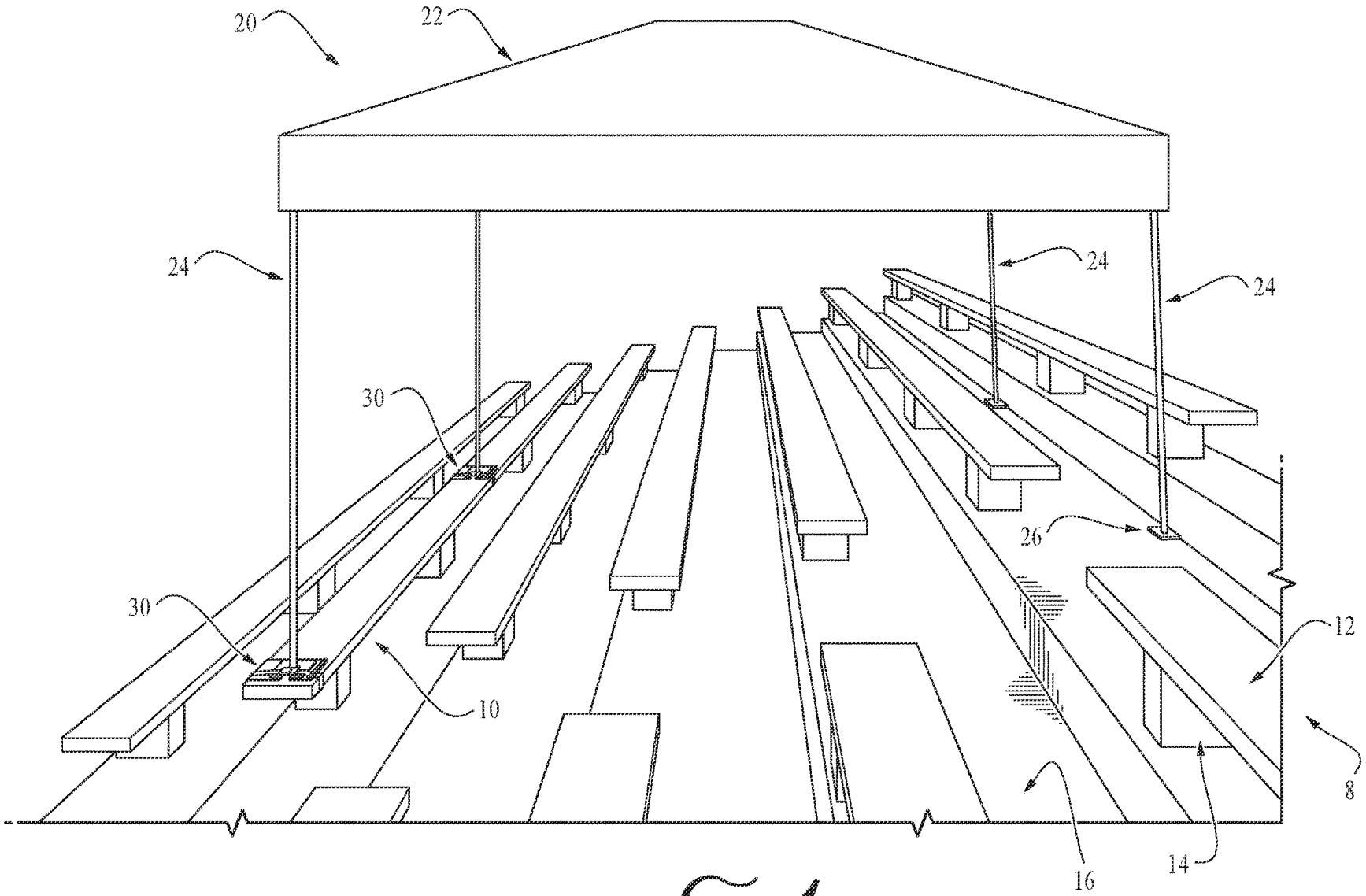
FIG. 1 is a side/top perspective view of a tent-to-seat mounting device according to a first example embodiment of the present invention, with the mounting device installed for use, securing a pop-up canopy tent to a bleacher seat.

FIGS. 1-7 show a mounting device 30 for securing a tent 20 to one or more seat pans 10 according to an example embodiment. As shown in FIG. 1, the depicted mounting device 30 can be used to secure a conventional pop-up canopy tent 20 to a conventional aluminum bleachers bench seat 10, though the mount 30 can be used with other tents and seats as noted above. The tent 20 includes a cover 22 and multiple adjustable-height legs 24 supporting the cover 22, with the cover typically being a rectangular flexible sheet (e.g., fabric or plastic), and with there typically being four legs 24. The legs 24 are typically of an adjustable-length type, for example with each having two telescopically arranged leg segments, a spring-biased pushbutton and cooperating serial holes for adjustably securing the two leg segments together at various extended/retracted positions to adjust the length of the leg 24 (and thus the height of the cover 22), and a flat support foot 26 at its bottom (for stability). And each bleachers seat 10 typically includes a seat pan (i.e., a plank) 12 supported by legs 14 on a footboard 16, with a series of the bench seats 10 in a tiered arrangement forming bleachers 8, and with the bench-seat pans/planks 12 for example about 2 inches by about 10-12 inches in cross section.

FIGS. 2-7 show details of the design and use of the mounting device 30. The mounting device 30 includes a mounting base 32 that retains one of the tent legs 24 in place and a coupling 34 that secures the mounting base 32 to the seat pan 12, thereby stably securing the tent 20 to the bench seat 10. The mounting base 32 can be mounted to the bench seat 10 by various different couplings 34. For example, the coupling 34 that secures the mounting base 32 to the seat pan 12 can be a clamp, clip, strap, or other conventional coupling that can be used to secure the mounting base 32 to the seat pan 12 to provide the functionality described herein.

Figure 2:
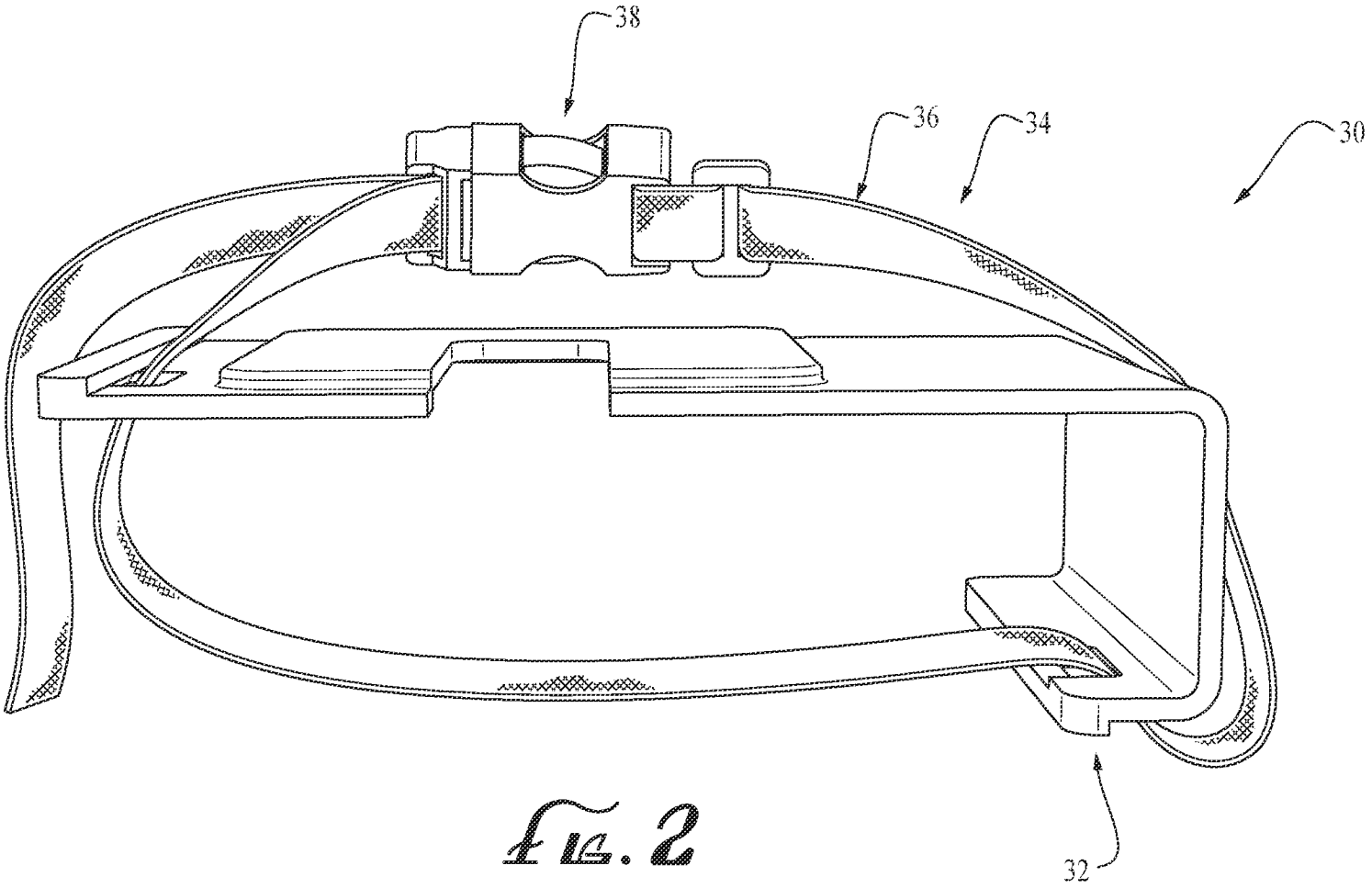
FIG. 2 is an opposite side/top perspective view of the mounting device of FIG. 1.

Referring particularly to FIG. 2, in the depicted embodiment, the coupling 34 is a strap that wraps around the seat pan 12 to mount the base plate 40 to the seat pan 10. The strap 34 includes a strip 36 of flexible material and a releasable fastener 38. The flexible strip 36 can be of a conventional type, for example 1-inch nylon webbing, that can be routed around the bench-seat pan 12 in a closed loop, as depicted. In other embodiments, the flexible strip can be a cable, cord, or other flexible (bendable) elongated element, whether resiliently elongatable (e.g., a BUNGEE cord) or substantially not (e.g., the depicted nylon webbing). The releasable fastener 38 can be a buckle, clamp, clip, hook, or other conventional component that releasably attaches together free ends of the flexible strip 36 in a closed loop around the bench-seat pan 12 and that is operable to tighten the flexible strip 36 to secure the mounting base 32 to the bench-seat pan 12 and to loosen the flexible strip 26 to remove the mounting base 32 from the seat pan 12. The fastener 38 is typically included as part of the strap 34, but it can alternatively be provided as part of the mounting base 32. In typical embodiments, the flexible strip 36 is coupled to the mounting base 32, either fixedly or removably attached, as discussed below.

In other embodiments, the strap includes two flexible strip segments each having an attached end that is coupled (fixedly or removably) to the mounting base and each having a free end so the two free ends couple together by the fastener (with the strap not extending all the way around the seat pan 12, and instead with the strap and the mounting base together forming the closed loop around the seat pan 12). In yet other embodiments, the strap is not coupled to the mounting base, and instead is completely unattached to the mounting base but simply wraps around it. In still other embodiments, multiple straps are provided for more stability.

Referring further to FIGS. 3A-7, the mounting base 32 includes a base plate 40 that retains the tent legs 24 in place and stably secures the tent 20 when the strap 34 is tightened around the bench 10. The base plate 40 is configured to be supported by and on a top surface of the bench-seat pan 10. The base plate 40 can be made of a hard plastic material and injection molded, it can be made of a metal, or it can be made of other materials using other fabrication methods known in the art.

The base plate 40 includes a tent-leg slot 42 with that removably receives and retains the respective tent leg 24 in it. The tent-leg slot 42 is open-ended, with an access opening 43 formed through and in communication with a side (e.g., front, rear, left, or right) of the base plate 40, and with the opening 43 receiving the tent leg 24 into and out of the tent-leg slot 42. The tent-leg slot 42 has a width that is large enough to slidingly receive the tent leg 26 but small enough to retain the tent leg 26 in place. That is, the width (front-to-back) of the tent-leg slot 42 is greater than the width of the tent legs 24, but smaller than the width (i.e., footprint) of the leg feet 26, so that one of the tent legs 24 can be laterally (horizontally, in use) received and retained in the slot 42 but cannot be pulled longitudinally/axially (vertically, in use) through the slot 42.

Figure 3A:
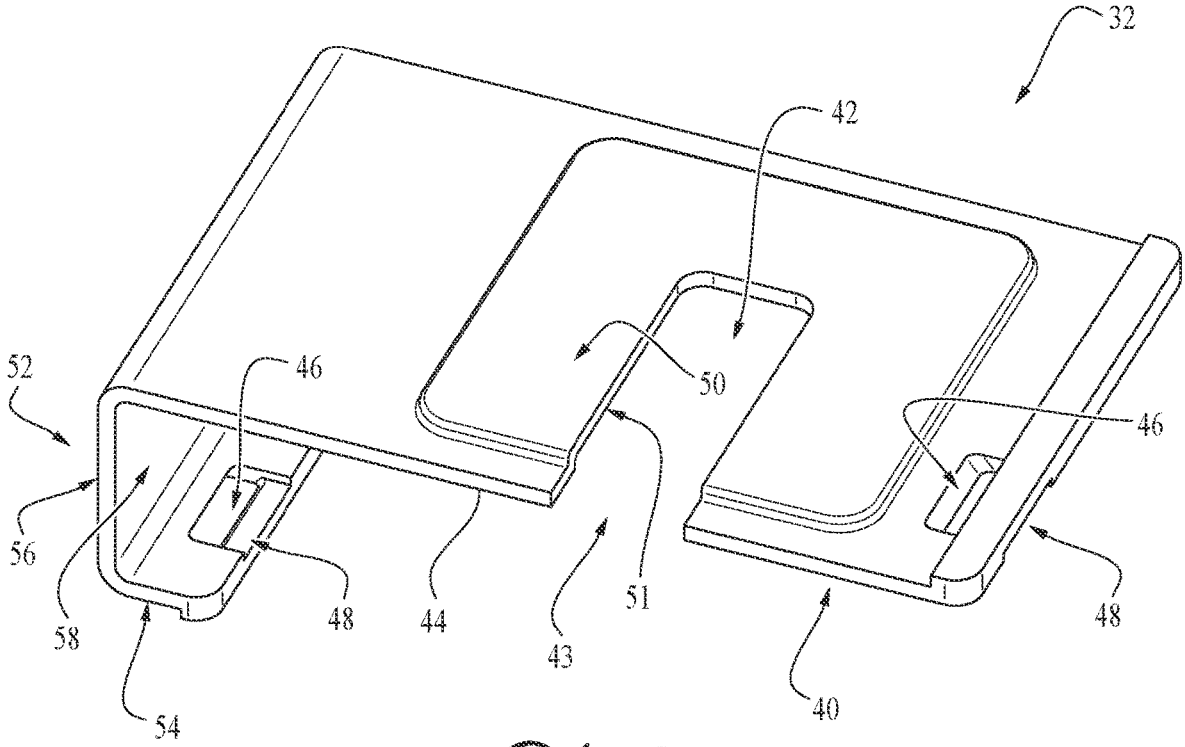
FIG. 3A is a side/top perspective view of a mounting base of the mounting device of FIG. 2.
Figure 3B:
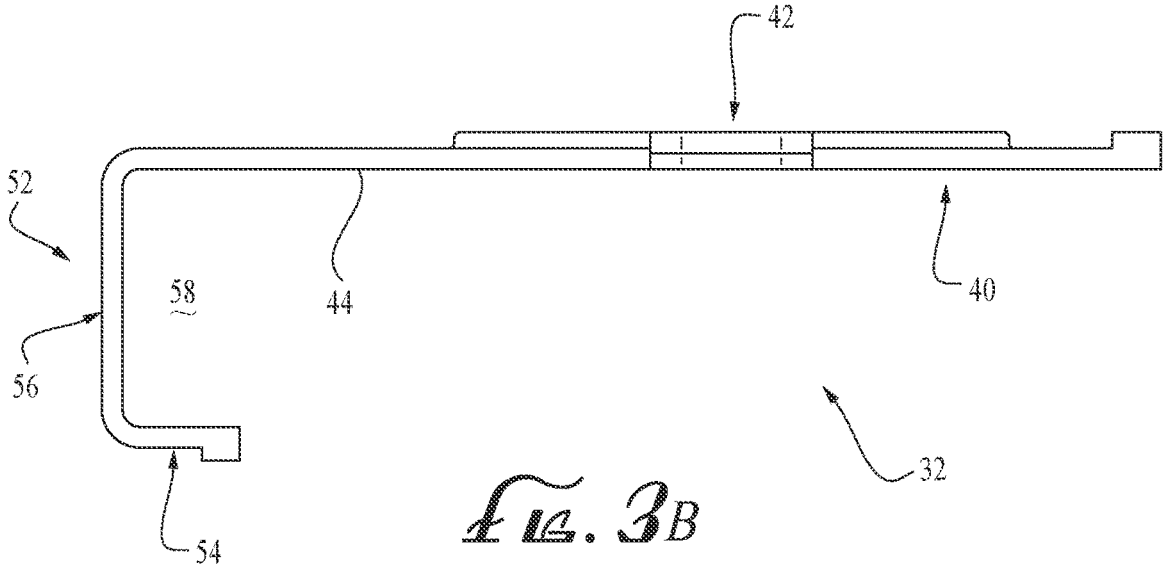
FIG. 3B is a side view of the mounting base of FIG. 3A.
Figure 3C:
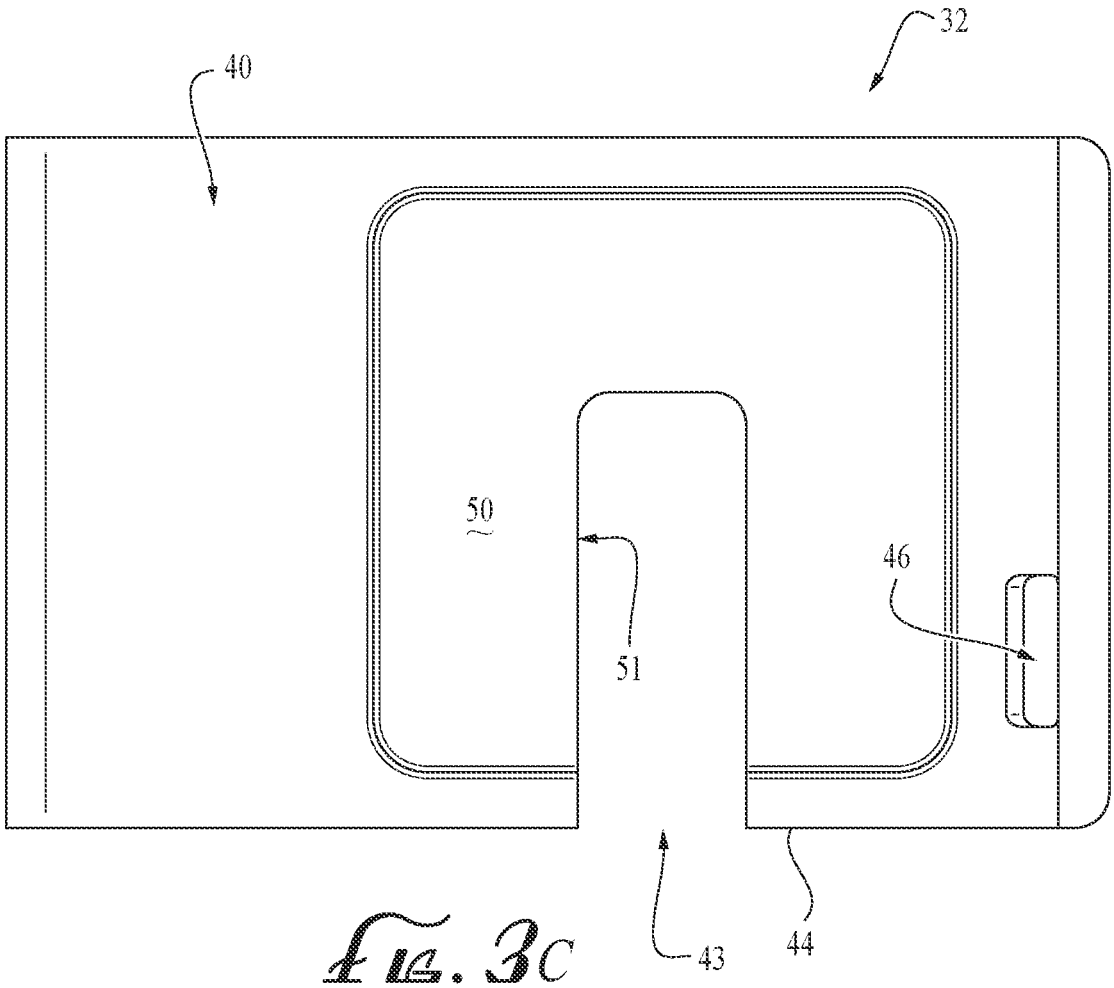
FIG. 3C is a top view of the mounting base of FIG. 3A.
Figure 3D:
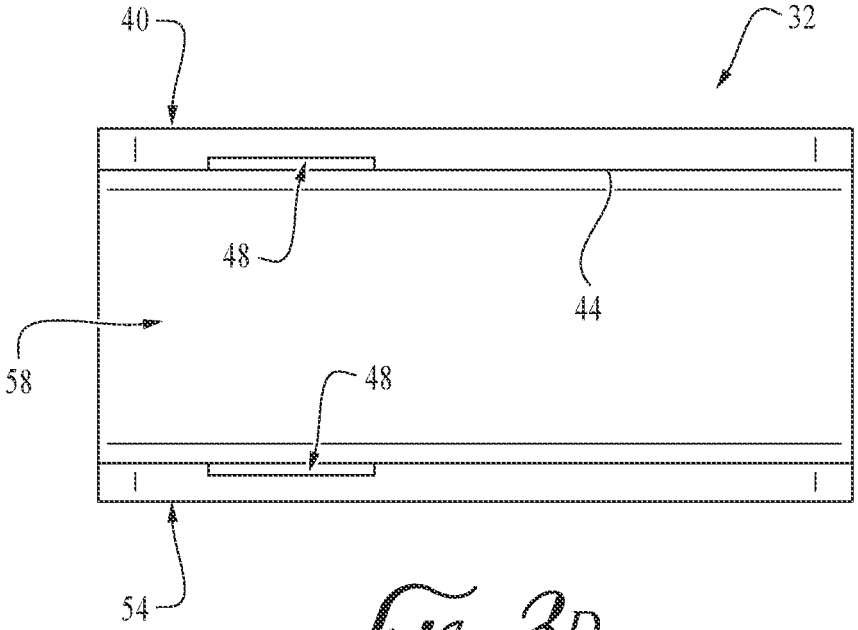
FIG. 3D is a bottom view of the mounting base of FIG. 3A.
Figure 4:
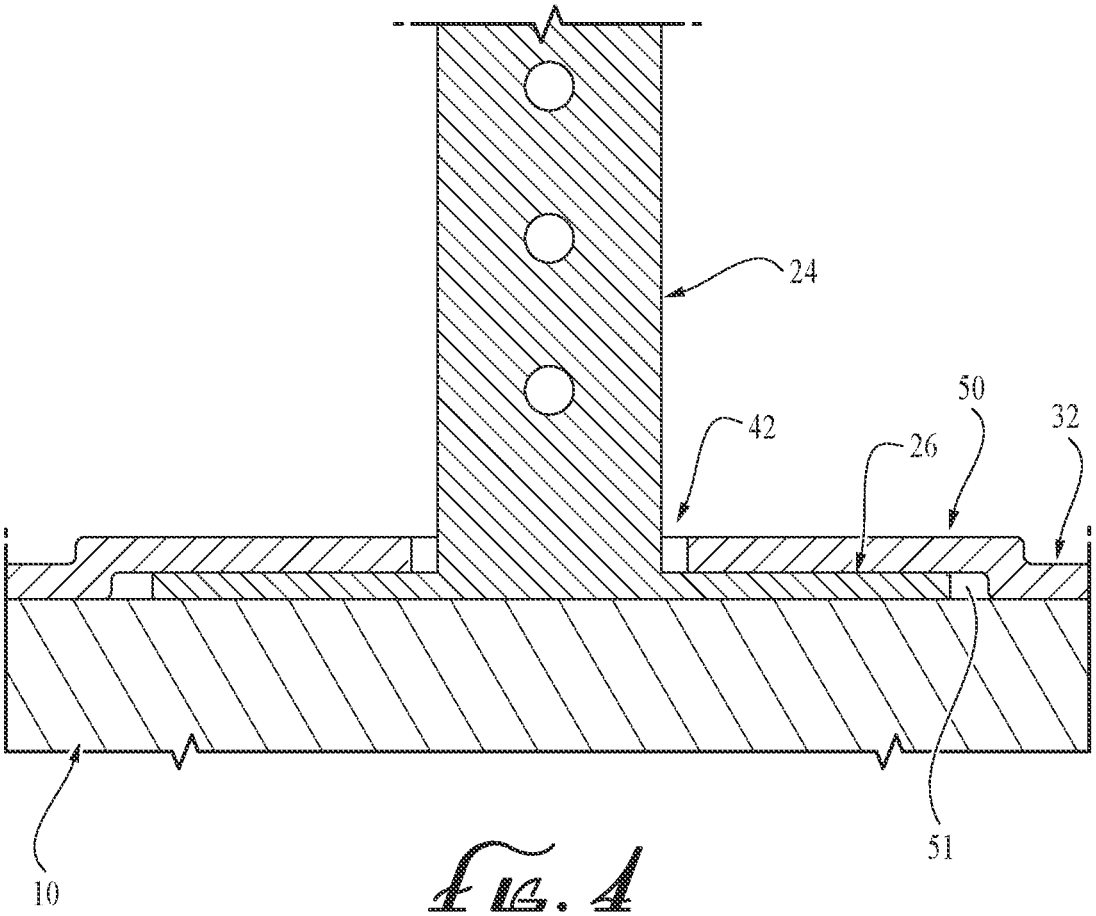
FIG. 4 is a side cross-sectional view of a portion of the mounting device, tent, and seat of FIG. 1, showing the mounting base retaining the tent leg to the seat pan.
Figure 5:
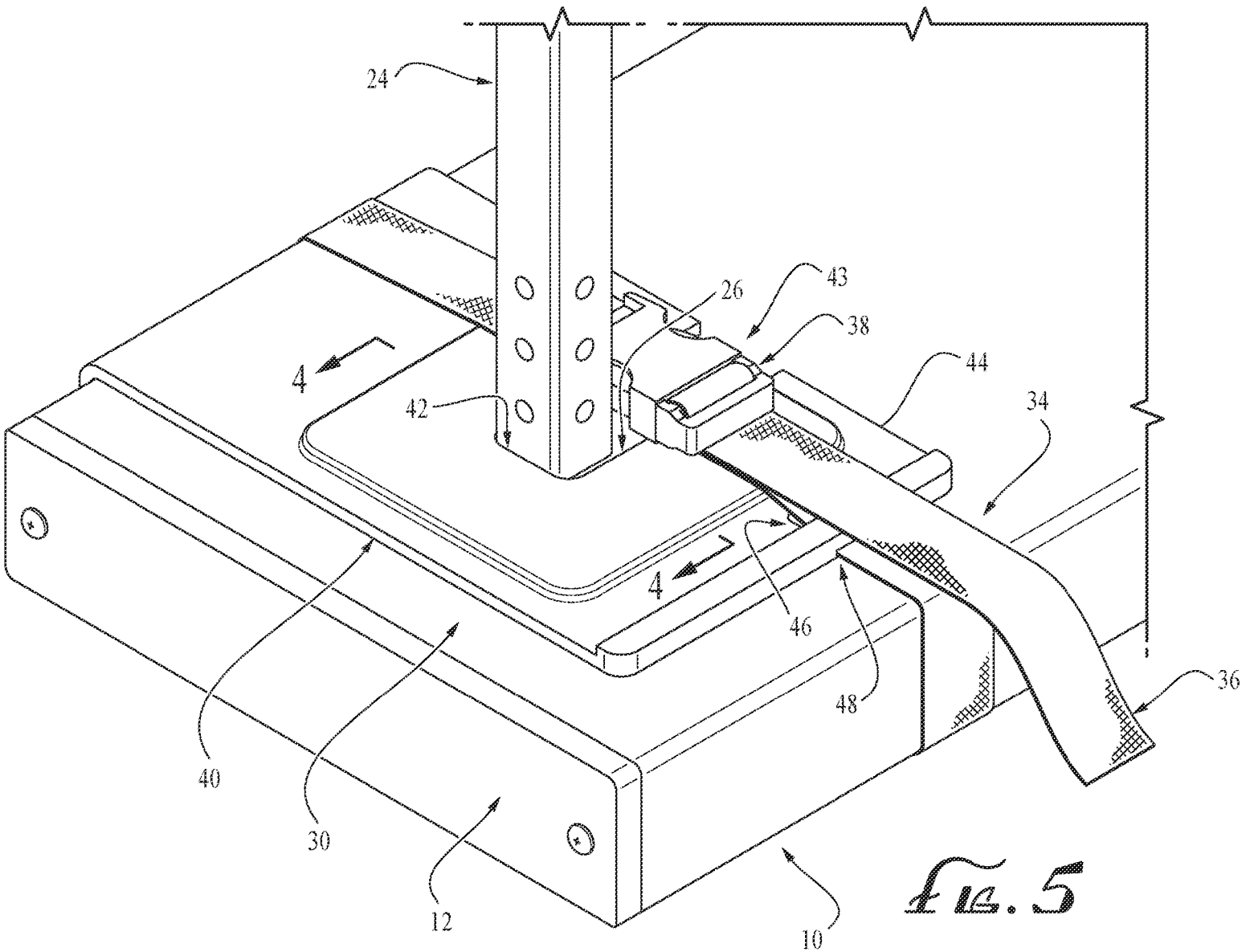
FIG. 5 is a top perspective view of a portion of the mounting device, tent, and seat of FIG. 1, showing the mounting base and strap retaining the tent leg to the seat pan.
Figure 6:
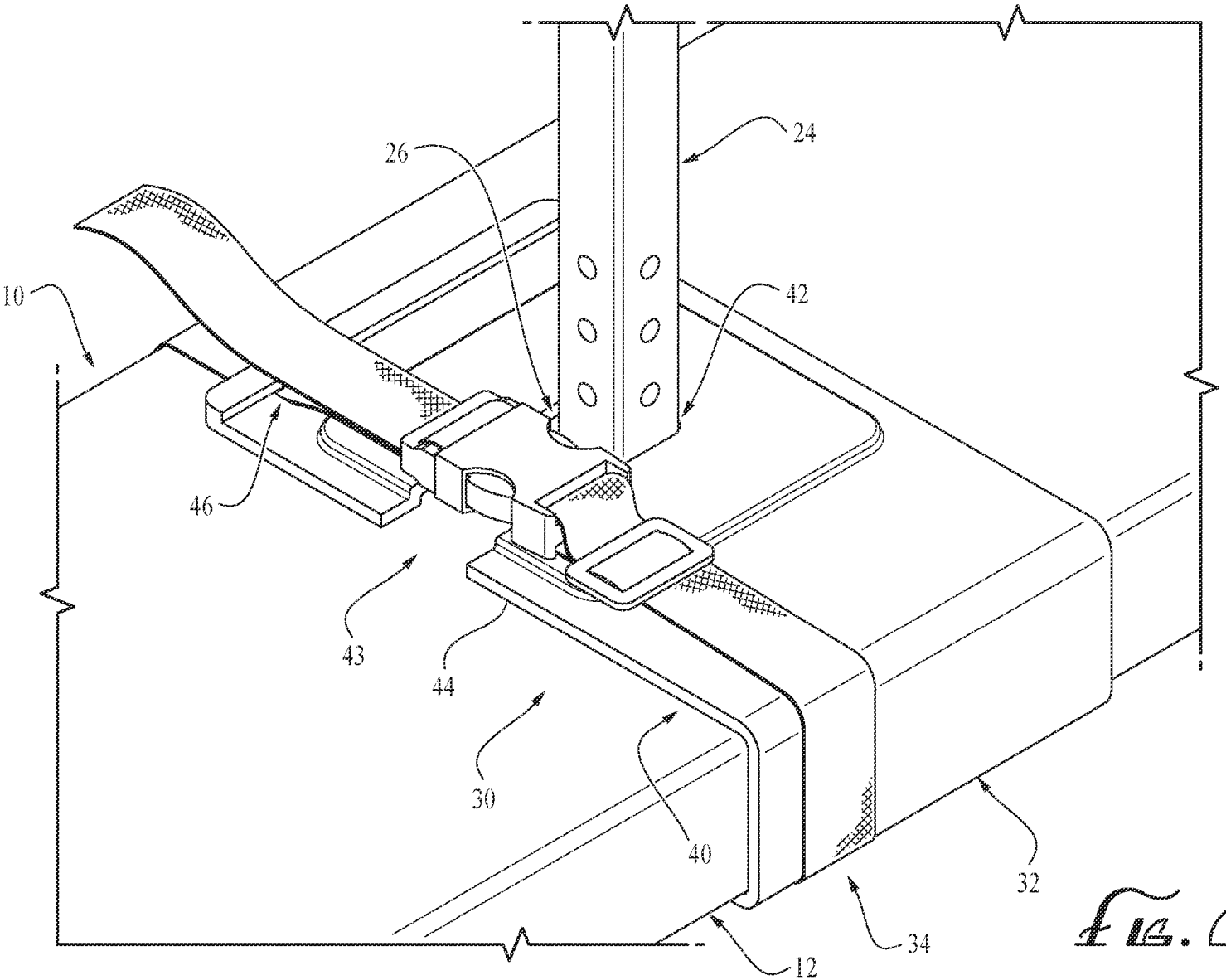
FIG. 6 is an opposite top perspective view of the mounting device, tent, and seat portions of FIG. 5.
Figure 7:
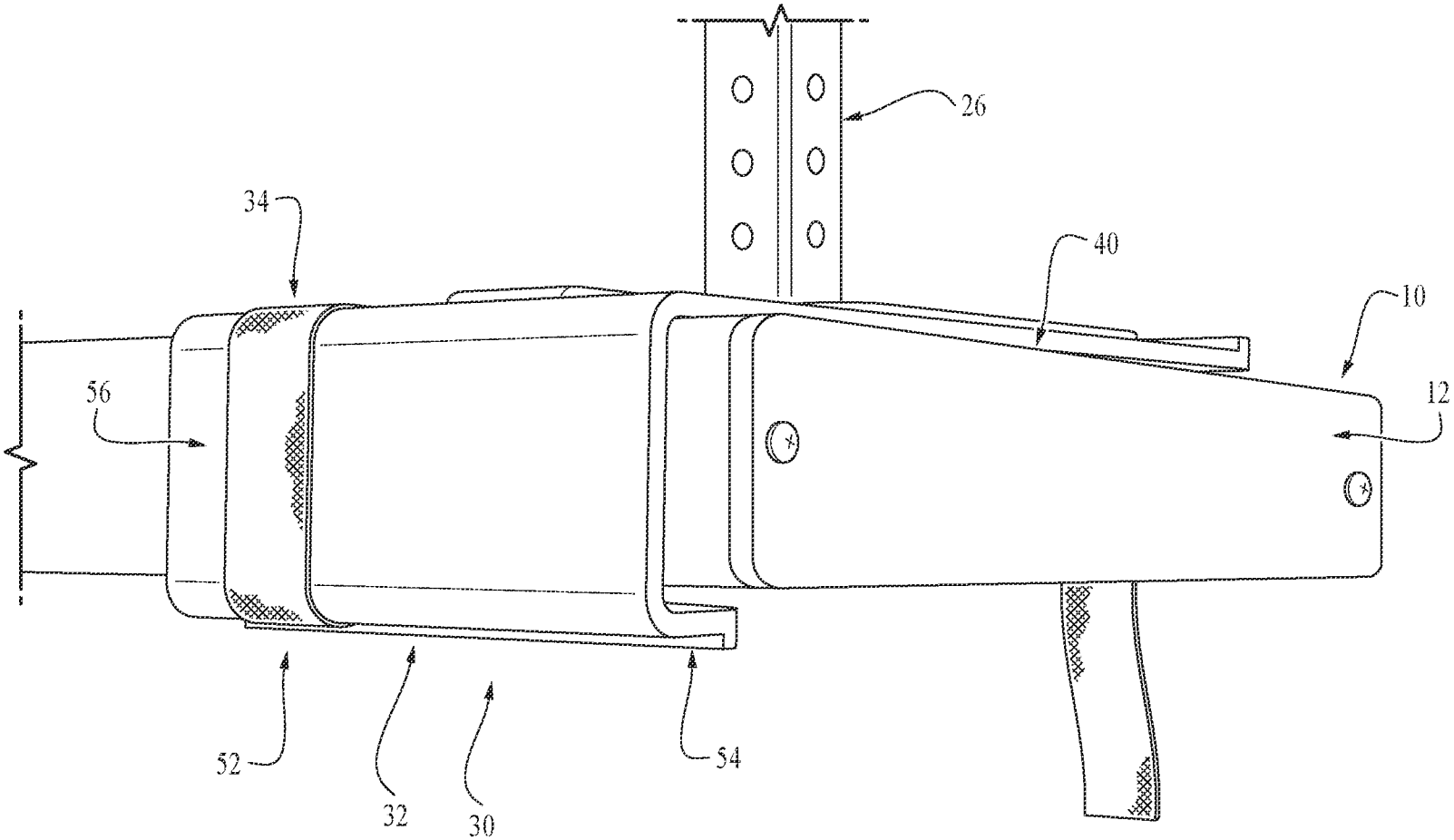
FIG. 7 is a side perspective view of the mounting device, tent, and seat portions of FIG. 5.

In some embodiments, the mounting device 30 include a closure feature that is selectively repositionable to close off the opening 43 to mechanically retain the tent leg 24 in the slot 42 or to clear the opening 43 so the tent leg 26 can be inserted into or removed from the slot 42. For example, in the depicted embodiment, the tent-leg slot 42 is configured and the strap 34 is positioned so that the strap 34 cooperates with the base plate 40 to retain the tent leg 24 from laterally sliding through the slot opening 43. For example, the depicted tent-leg slot 42 extends laterally (in a direction along the length of the bench-seat pan 12, in use) in the base plate 40, with its opening 43 in communication with a lateral side 44 of the base plate 40 (FIGS. 3A-C). The length (side-to-side) of the tent-leg slot 42 is greater than, in combination, the width (i.e., footprint) of the leg feet 26 (so the base plate 40 completely covers the leg feet) plus the width of the strip 36 (so the strip 36 can be routed over that portion of the base plate 40). Also, the flexible strip 36 routes around the seat pan 12 so that the strip 36 is positioned between the tent leg 24 in the tent-leg slot 42 and the lateral side 44 of the base plate 40. In this way, the strip 36 covers the slot opening 43 and closes off the tent-leg slot 42, thereby laterally retaining the tent leg 26 in place within the tent-leg slot42 (FIGS. 5-6). As such, the strap double-functions as the coupling and the closure in these embodiments.

In yet other embodiments, the closure feature includes a gate that pivots between an interference position (mechanically retaining the tent leg in the leg-retaining slot, by closing off the slot) and a clearance position (not retaining the tent leg in the slot, clear of blocking/closing off the slot). In some such embodiments, the flexible strip is provided and attached to the free end (opposite the pivot end) of the gate so that the strap secures the mounting plate to the seat pan but does not retain the tent leg in the leg-retaining slot. In still other embodiments, the closure feature includes a latch, slide lock, or other mechanical element that can be repositioned to close off the slot or not to provide the slot closure functionality described herein.

The strap 34 couples to the mounting base 32 by one or more attachment features. In the depicted embodiment, for example, the attachment features are two closed strap slots 46 that each receive the strip 36 through them so that the strip 36 is retained to the mounting base 32 in use, but can still slide longitudinally/axially through the strap-retaining slots 46 for positioning and tightening. Typically, one free end of the strip 36 can slide out through the strap slots 46 so that the strap 34 can be removed/detached from and reattached to the mounting base 32 (e.g., for installing to the bench-seat pan 12 between two laterally spaced bench-seat legs 14). In other embodiments, the attachment features can be clips, slotted protrusions, or other components that provide the attachment functionality described herein.

In addition, the strap slots 46 can be located at peripheral portions of the mounting base 32. In such embodiments, the mounting base 32 at those locations can have strap-receiving recesses 48 in its inner surface (facing and contacting the bench-seat plank 12) and in communication with the strap slots 46, for example as depicted. The depth of the strap-receiving recesses 48 is greater than the thickness of the flexible strip 36. In this way, the strap recesses 48 receive the strip 36 through them without a tight fit in use, so that the strip 36 is not pinched between the mounting base 32 and the bench-seat pan 12 and yet the rest of the base plate 40 (or at least the rest of its periphery) is in contact with the bench seat 10.

Furthermore, the base plate 40 typically has a recessed portion 50 forming a tent-foot recess 51 relative to the rest of the base plate 40. The tent-leg slot 42 is formed (e.g., centrally) in the recessed portion 50 of the base plate 40 (FIGS. 3-4), so one of the tent legs 24 can be slide laterally into the tent-leg slot 42 to position the respective tent foot within the tent-foot recess 51, with the recessed portion 50 thus covering the tent leg foot to retain it in place.

The recessed portion 50 is configured (shaped and sized) so that the tent-foot recess 51 can receive one of the tent-leg feet 26 and yet that the remainder of the base plate 40 can remain in flush contact with the bench-seat pan 12, thereby providing good retaining and stability functionality. Typical tent-leg feet 26 are rectangular, and so the recessed portion 50 is typically rectangular, as depicted. Also, the depth of the tent-foot recess 51 is greater than the thickness of the tent foot 26, and the width of the tent-foot recess 51 is greater than the width of the tent foot 26. As such, the recessed portion 50 has a depth and width/length selected to be big enough to receive tent-leg feet 26 of conventional tents 20 but small enough to provide good retaining/securing functionality, for example at least about four inches by about four inches wide/long forming a square shape.

In addition, the recessed portion 50 of the base plate 40 is typically offset laterally from the lateral side 44 of the base plate 40 (FIGS. 3A and 3C). That is, the tent-leg slot 42 is formed through the recessed portion 50 of the base plate 40 and through the adjacent non-recessed portion of the base plate 40 (the lateral offset between the recessed portion 50 and the lateral side 44 with the side opening 43). In typical embodiments, for example, this recess offset is about 0.25 inches to about 1.0 inches. As such, the recessed portion 50 of the base plate 40 laterally retains the tent foot 26 within it when the mounting plate 40 is secured to the seat pan 12, so the tent leg 24 cannot slide laterally out of the slot opening 43, thereby securing the tent 20 in place. In other embodiments, the recessed portion of the base plate extends to the lateral edge of the base plate, so that the tent leg can be slid into or out of the slot (because the leg foot can be slid into or out of the recess) when the mounting plate 40 is positioned in place on the bench-seat pan 12.

The base plate 40 has a size and shape to provide stability to the tent 20 it mounts to the bench seat 10. In the depicted embodiment, for example, the base plate 40 has a rectangular shape, though alternatively it could have a polygonal, circular, or other regular or irregular shape.

As for size, the base plate 40 is typically selected with a width (front to back, with the front side facing and closet to the field of action) and a length (laterally, along the length of the bench) that is larger than, and thus covers, the tent foot 26 it mounts in place to provide stability and resist the wind blowing the tent 20 over. Also, the base plate 40 width is typically less than the width of the bench-seat pan 12 it is to be mounted to, so that the base plate 40 does not extend/protrude beyond the bench seat 10 and create a tripping or snagging hazard. Typical bench-seat pans/planks 12 of bleacher seats are about 10 inches to 12 inches in width (between front and rear minor sides). As such, in example embodiments, the base plate 40 typically has a width of more than (or about) one inch and less than (or about) 10 inches, and a length of more than (or about) two inches. It should be noted that, as in the depicted embodiment, the width can be greater than the length.

To provide further stability, the mounting base 32 can include a clip 52 extending from the front or rear side of the base plate 40. In the depicted embodiment, for example, the clip 52 includes a flange panel 54 that is substantially parallel to the base plate 40 and a connecting panel 56 that extends between and is perpendicular to the base plate 40 and the flange panel 54. The clip 52 defines a channel 58 that receives (and thus clips onto) the bench-seat pan/plank 12, for example with a snug fit. Typical bench-seat pans 12 have a thickness (between top and bottom major sides) of about 2 inches, and so the clip 52 can be dimensioned so the channel 58 height (between the base plate 40 and the flange panel 54) is slightly greater than, or about the same as, the plank thickness (or slightly less for embodiments in which the mounting base 32 is made of a material that enables sufficient resilient deflection of the flange panel 54 relative to the base plate 40).

In typical embodiments, the mounting base 32 can be installed (e.g., clipped) onto the front or rear of the bench seat 10. In other embodiments, the mounting base includes a second clip at the opposite end of the mounting base, and in some such embodiments the second clip can be adjustably positioned for use on different sizes of seat pans 12 and/or the clip/s can function as the coupling that secures the mounting base to the seat pan 12.

In embodiments including the mounting-base clip 52, the closed end of the tent-leg slot 42 (where the tent leg 24 is retained) is positioned at an offset (front-to-back) from the connecting panel 56 of the clip 52. In typical embodiments, this slot offset is about 4.0 inches to about 8.0 inches. This auto-positions the closed end of the tent-leg slot 42 sufficiently away from the edge of the seat pan 12 that the tent leg 24 is retained in place with the leg foot 26 not overhanging the seat pan 12 and provide good stability.

Typical commercial embodiments include the mounting device 30 itself, the mounting device 30 and a tent 20 provided together, a method of installing a tent 20 to a bench seat 10 using the mounting device 30, and the resulting system of a tent 20 mounted to one or more seats 10 by the mounting device 30.

To install the mounting device 30 for use, the tent 20 is deployed with at least one of the tent legs 24 positioned on top of a selected bench-seat pan/plank 12 and the mounting base 32 is positioned on top of the same bench pan/plank 12. The mounting base 32 and/or the tent 20 are moved relative to each other so that the respective tent leg 24 is received into the tent-leg slot 42 of the mounting base 32, and the strap 34 is routed around the bench-seat plank 12 and tightened using the fastener 38 to secure the mounting device 30, and thus the tent 20, to the bench seat 10. The process can then be repeated for more or all of the tent legs 24 to secure the tent 20 in place. When installing the tent 20 to cover multiple tiers/rows of seats 10, the front and rear tent legs 24 are adjusted to different lengths the so that the cover 22 is generally level.

The mounting devices 30 can be partially installed on the seat 10 (e.g., clipped into position by the clip 52 but not strapped down tightly by the fastener 38), then the tent 20 deployed and moved laterally so that it's legs 24 and feet 26 slide into the tent-leg retainer slots 42, and then the mounting devices 30 can be fully secured in place by tightening down the straps 34 to complete the installation. Alternatively, the tent 20 can be fully deployed and then the mounting devices 30 slid onto the tent legs 24 and feet 26 and then secured in place using the strap 34 (e.g., if there is little wind).

In a typical use (FIG. 1), two of the mounting devices 30 are secured to one of the bench-seat pans/planks 12. In this arrangement, the two front tent legs 24 are fully extended and secured to the two mounting devices 30, and the two rear tent legs 24 are at least partially retracted (so that the cover 22 is generally level) and rest unattached on one of the footboards 16 (or other bench seats) higher up in the bleachers 8.

In a related use (not shown), the installation is the same, except reversed, with the rear tent legs 24 secured to one of the bench-seat pan/planks 12 by two of the mounting devices 30 and the two front tent legs 24 resting unattached on one of the footboards 16 (or other bench seats) lower down in the bleachers 8. In another related use (not shown), two of the tent legs 24 are secured to one bench-seat plank 12 by two mounting devices 30 and the other two tent legs 24 are secured to another bench-seat plank 12 by two other mounting devices 30 so that all four tent legs 24 are secured to the bleachers 8.

In yet another use (not shown), the front or rear two tent legs 24 are secured to one bench-seat pan/plank 12 by two mounting devices 30 and the other two tent legs 24 extend down between and below two other bench seats 10 and rest on the ground under the bleachers 8 (without footboards 16), with the front and rear tent legs 24 adjusted to different lengths the so that the cover 22 is generally level. In still another use (not shown), two or more of the mounting devices 30 are secured to two aligned bench-seat pans/planks 12 of adjacent bleachers 8 so that the tent 20 spans the two bleachers 8.

And in still yet another use (not shown), two of the tent legs 24 are secured to one bench-seat pan/plank 12 by two mounting devices 30 and the other two tent legs 24 rest on the ground in front of or behind the bench seat 10, with the front and rear tent legs 24 adjusted to different lengths the so that the cover 22 is generally level.

It is to be understood that this invention is not limited to the specific devices, methods, conditions, and/or parameters described and/or shown herein, and that the terminology used herein is for the purpose of describing particular embodiments by way of example only. Thus, the terminology is intended to be broadly construed and is not intended to be unnecessarily limiting of the claimed invention. For example, as used in the specification including the appended claims, the singular forms "a," "an," and "one" include the plural, the term "or" means "and/or," and reference to a particular numerical value includes at least that particular value, unless the context clearly dictates otherwise. In addition, any methods described herein are not intended to be limited to the specific sequence of steps described but can be carried out in other sequences, unless expressly stated otherwise herein.

While the invention has been shown and described in exemplary forms, it will be apparent to those skilled in the art that many modifications, additions, and deletions can be made therein without departing from the spirit and scope of the invention as defined by the following claims.

What is claimed is:

1. A mounting device for securing a tent to a seat, the tent having legs with feet, and the seat having a seat pan, the mounting device comprising:

a mounting base including a base plate configured to be supported by and on a top surface of the seat pan in a horizontal position, wherein the horizontal base plate includes a lateral slot that removably receives one of the vertical tent legs, wherein the lateral slot is open-ended with an opening that extends through a side of the horizontal base plate and through which the tent leg relatively slides laterally into and out of the lateral slot, wherein the lateral slot is configured to be sufficiently large to laterally slidingly receive the respective tent leg, wherein the lateral slot is configured to be sufficiently small that the respective tent-leg foot cannot be longitudinally passed vertically therethrough, wherein with the respective tent leg received in the lateral slot, the horizontal base plate adjacent the lateral slot retains the respective tent-leg foot from longitudinally passing vertically upward through the lateral slot so that the horizontal base plate retains the respective tent leg from longitudinally moving vertically upward away from the seat pan;

a coupling that secures the mounting base to the seat pan to securely mount the tent to the seat, wherein the coupling is provided by a strap that routes around the seat pan to secure the mounting base to the seat pan; and a closure that is configured to be repositionable to close off the lateral slot opening to retain the tent leg in the lateral slot or to be clear of the lateral slot opening to allow the tent leg to be inserted into or removed from the lateral slot, wherein the strap extends between the lateral slot opening and the tent leg to close off the lateral slot and thereby retain the tent leg within the lateral slot, wherein the strap double-functions as the coupling and the closure.

2. The mounting device of claim 1, wherein the horizontal base plate includes a recessed portion defining a recess that is configured to receive and retain the tent leg foot, wherein the lateral slot extends through the recessed portion so that when the tent leg is received in the lateral slot, the recess receives the tent-leg foot with the tent leg foot and the rest of the horizontal base plate making flush contact with the seat pan, wherein in use the recessed portion covers the tent leg foot to retain it in place.

3. The mounting device of claim 2, wherein the recessed portion is offset from the side of the horizontal base plate that the lateral slot opening extends through so that the recessed portion laterally retains the tent-leg foot within the recess when the mounting base is secured to the seat pan so that the tent leg cannot slide laterally out of the lateral slot.

4. The mounting device of claim 1, wherein the mounting base includes at least one strap slot that slidingly receives the strap to attach the strap to the mounting base.

5. The mounting device of claim 4, wherein the strap slot is located at a peripheral portion of the horizontal mounting base and includes a strap recess configured so that, during use with the horizontal mounting base secured to the seat pan, the strap recess receives the strap with a loose fit, with the strap not pinched between the horizontal mounting base and the seat pan, and with the rest of the base plate in flush contact with the seat pan.

6. The mounting device of claim 1, wherein the mounting base includes a clip extending from the horizontal base plate, wherein the clip forms a channel that receives the seat pan.

7. An assembly including the tent and the mounting device of claim 1 provided together.

8. The mounting device of claim 1, wherein the mounting base includes a clip extending from the horizontal base plate, wherein the clip forms a channel that receives the seat pan.

9. A method of securing a tent to a seat, the tent having legs, and the seat having a seat pan, the method comprising:

providing a mounting device, comprising:

a mounting base including a base plate configured to be supported by and on a top surface of the seat pan, wherein the base plate includes a slot that removably receives one of the tent legs, wherein the tent-leg slot is open-ended with an opening that extends through a side of the base plate and through which the tent leg relatively slides into and out of the slot, and wherein the slot is configured to be sufficiently large to laterally slidingly receive the tent leg and sufficiently small to retain the respective tent-leg foot from longitudinally passing through the slot; and a coupling that secures the mounting base to the seat pan to securely mount the tent to the seat;

deploying the tent with at least one of the tent legs positioned on the seat pan;

positioning the mounting base on the seat pan;

moving the mounting base and/or the tent relative to each other so that the tent leg is received through the slot opening and into the slot of the mounting base;

installing the coupling to secure the mounting base, and thus the tent leg, to the seat pan; and adjusting a length of the leg to be different from a length of another one of the tent legs so that a cover of the tent is generally level.

10. The mounting device of claim 9, wherein moving the mounting base and/or the tent relative to each other further comprises laterally sliding movement between the tent leg and the base plate so that the tent leg slides laterally through the slot opening and into the slot of the mounting base.

11. A mounting device for securing a tent to a seat, the tent having legs with feet, and the seat having a seat pan, the mounting device comprising:

a mounting base including a base plate configured to be supported by and on a top surface of the seat pan, wherein the base plate includes a slot that removably receives one of the tent legs, wherein the tent-leg slot is open-ended with an opening that extends through a side of the base plate and through which the tent leg relatively slides into and out of the slot, wherein the slot is configured to be sufficiently large to laterally slidingly receive the tent leg and sufficiently small to retain the respective tent-leg foot leg from longitudinally passing through the slot; and a strap that double-functions as a coupling and a closure, wherein the coupling secures the mounting base to the seat pan to securely mount the tent to the seat, wherein the strap functioning as the coupling routes around the seat pan to secure the mounting base to the seat pan, wherein the closure is configured to be repositionable to close off the slot opening to retain the tent leg in the slot or to be clear of the slot opening to allow the tent leg to be inserted into or removed from the slot, wherein the strap functioning as the closure closes off the slot opening to retain the tent leg in the slot when the strap is coupling the mounting base to the seat pan.

12. The mounting device of claim 11, wherein the strap extends between the slot opening and the tent leg to close off the slot and thereby retain the tent leg within the slot.

13. The mounting device of claim 11, wherein the mounting base includes a clip extending from the base plate, wherein the clip forms a channel that receives the seat pan.

14. The mounting device of claim 11, wherein the base plate further includes a recessed portion defining a recess that is configured to receive and retain the tent leg foot and to allow the rest of the base plate to make flush contact with the seat pan, wherein in use the recessed portion covers the tent leg foot to retain it in place.

15. The mounting device of claim 14, wherein the slot extends through the recessed portion so that the recess receives the tent-leg foot when the tent leg is received in the slot.

16. The mounting device of claim 14, wherein the recessed portion is offset from the side of the plate that the opening extends through so that the recessed portion laterally retains the tent foot within the recess when the mounting plate is secured to the seat pan so that the tent leg cannot slide laterally out of the slot.

17. A mounting device for securing a tent to a seat, the tent having legs with feet, and the seat having a seat pan, the mounting device comprising:

a mounting base including a base plate configured to be supported by and on a top surface of the seat pan in a horizontal position, wherein the horizontal base plate includes a lateral slot that removably receives one of the vertical tent legs, wherein the lateral slot is open-ended with an opening that extends through a side of the horizontal base plate and through which the tent leg relatively slides laterally into and out of the lateral slot, wherein the lateral slot is configured to be sufficiently large to laterally slidingly receive the respective tent leg, wherein the lateral slot is configured to be sufficiently small that the respective tent-leg foot cannot be longitudinally passed vertically therethrough, wherein with the respective tent leg received in the lateral slot, the horizontal base plate adjacent the lateral slot retains the respective tent-leg foot from longitudinally passing vertically upward through the lateral slot so that the horizontal base plate retains the respective tent leg from longitudinally moving vertically upward away from the seat pan;

a coupling that secures the mounting base to the seat pan to securely mount the tent to the seat; and a closure that is configured to be repositionable to close off the lateral slot opening to laterally retain the tent leg in the lateral slot or to be clear of the lateral slot opening to allow the tent leg to be laterally inserted into or removed from the lateral slot, wherein the coupling and the closure are provided by one element that double-functions as both the coupling and the closure.

18. The mounting device of claim 17, wherein the single element is positionable between the lateral slot opening and the tent leg to close off the lateral slot and thereby retain the tent leg within the lateral slot.

19. The mounting device of claim 17, wherein the horizontal base plate includes a recessed portion defining a recess that is configured to receive and retain the tent leg foot, wherein the lateral slot extends through the recessed portion so that when the tent leg is received in the lateral slot, the recess receives the tent-leg foot with the tent leg foot and the rest of the horizontal base plate making flush contact with the seat pan, wherein in use the recessed portion covers the tent leg foot to retain it in place.

20. The mounting device of claim 19, wherein the recessed portion is offset from the side of the horizontal base plate that the lateral slot opening extends through so that the recessed portion laterally retains the tent-leg foot within the recess when the mounting base is secured to the seat pan so that the tent leg cannot slide laterally out of the lateral slot.

* * * * *